US012371910B2

(12) United States Patent
Hannig et al.

(10) Patent No.: US 12,371,910 B2
(45) Date of Patent: Jul. 29, 2025

(54) PANEL

(71) Applicant: Surface Technologies GmbH & Co. KG, Baruth (DE)

(72) Inventors: Hans-Jürgen Hannig, Bergisch Gladbach (DE); Egon Hoff, Mastershausen (DE)

(73) Assignee: SURFACE TECHNOLOGIES GMBH & CO. KG, Baruth (DE)

( * ) Notice: Subject to any disclaimer, the term of this patent is extended or adjusted under 35 U.S.C. 154(b) by 0 days.

(21) Appl. No.: 17/761,423

(22) PCT Filed: Sep. 17, 2021

(86) PCT No.: PCT/EP2021/075601
§ 371 (c)(1),
(2) Date: Mar. 17, 2022

(87) PCT Pub. No.: WO2022/058488
PCT Pub. Date: Mar. 24, 2022

(65) Prior Publication Data

US 2022/0389720 A1 Dec. 8, 2022

(30) Foreign Application Priority Data

Sep. 17, 2020 (EP) ..... 20196643

(51) Int. Cl.
*E04F 15/02* (2006.01)

(52) U.S. Cl.
CPC .. *E04F 15/02038* (2013.01); *E04F 15/02016* (2013.01); *E04F 15/02033* (2013.01);
(Continued)

(58) Field of Classification Search
CPC ..... E04F 15/02038; E04F 15/02016; E04F 15/02033; E04F 2201/0146;
(Continued)

(56) References Cited

U.S. PATENT DOCUMENTS 7,584,583 B2 * 9/2009 Bergelin ..... E04F 15/02188 52/177
7,866,110 B2 1/2011 Pervan
(Continued)

FOREIGN PATENT DOCUMENTS

DE 202019101807 U1 5/2019
EP 1415056 B1 1/2006
(Continued)

*Primary Examiner* — Brent W Herring
(74) *Attorney, Agent, or Firm* — LUCAS & MERCANTI, LLP; Klaus P. Stoffel

(57) ABSTRACT

A panel having a core, a top side, a underside, a first edge pair and a second edge pair. The first edge pair has a groove profile at a panel edge and a complementary tongue profile at the opposite panel edge, which cooperate in positively locking relationship so that movement of locked panels away from each other in the plane of the panels is opposed. At its opposite panel edges the second edge pair has a receiving hook and a complementary arresting hook. The arresting hook can be assembled to the receiving hook by a joining movement in a direction perpendicular to the panel plane. The receiving hook has a holding groove for a separate locking element for a vertical locking action. At a corner of the panel the tongue edge of the first edge pair comes together with the receiving hook. The holding groove provided on the receiving hook of the second edge pair for the locking element has an upper groove wall with a spacing from the top side that is greater than the spacing between the panel top side and the tongue top side of the tongue profile of the first edge pair.

11 Claims, 7 Drawing Sheets

(52) U.S. Cl.
CPC ..... *E04F 2201/0146* (2013.01); *E04F 2201/0153* (2013.01); *E04F 2201/0535* (2013.01); *E04F 2201/0547* (2013.01)

(58) Field of Classification Search
CPC ..... E04F 2201/0153; E04F 2201/0535; E04F 2201/0547
USPC ..... 52/582.2
See application file for complete search history.

(56) References Cited

U.S. PATENT DOCUMENTS

| | | | | |
|---|---|---|---|---|
| 8,966,853 | B2 | 3/2015 | Hannig | |
| 9,347,469 | B2 | 5/2016 | Pervan | |
| 9,453,347 | B2 | 9/2016 | Pervan | |
| 2006/0101769 | A1* | 5/2006 | Pervan | F16B 5/0004 52/591.1 |
| 2008/0010937 | A1* | 1/2008 | Pervan | E04F 15/02 52/588.1 |
| 2008/0104921 | A1* | 5/2008 | Pervan | E04F 15/10 52/588.1 |
| 2008/0110125 | A1* | 5/2008 | Pervan | E04F 15/04 52/582.2 |
| 2008/0134614 | A1* | 6/2008 | Pervan | E04B 5/00 52/588.1 |
| 2010/0043333 | A1* | 2/2010 | Hannig | F16B 5/0056 52/582.2 |
| 2013/0008118 | A1* | 1/2013 | Baert | E04F 15/02016 156/60 |
| 2013/0014463 | A1* | 1/2013 | Pervan | E04F 15/107 52/582.2 |
| 2014/0366476 | A1 | 12/2014 | Pervan | |
| 2015/0113908 | A1* | 4/2015 | Ramachandra | E04F 15/02022 52/745.13 |
| 2016/0153200 | A1* | 6/2016 | Pervan | E04F 15/102 52/582.2 |
| 2016/0340913 | A1* | 11/2016 | Derelov | A47B 47/00 |
| 2017/0037640 | A1* | 2/2017 | Boucké | E04F 15/02038 |
| 2018/0216353 | A1* | 8/2018 | Hannig | E04F 15/02033 |
| 2020/0123788 | A1* | 4/2020 | Baert | B32B 13/14 |
| 2020/0224430 | A1* | 7/2020 | Ylikangas | E04F 15/02038 |
| 2021/0087829 | A1* | 3/2021 | Ylikangas | B27M 3/06 |
| 2021/0087830 | A1* | 3/2021 | Ylikangas | E04F 15/02038 |
| 2021/0238863 | A1 | 8/2021 | Sieder | |
| 2021/0310256 | A1* | 10/2021 | Boo | E04F 13/0894 |
| 2022/0010974 | A1* | 1/2022 | Lofholm | F16B 5/0056 |
| 2022/0127850 | A1* | 4/2022 | Boo | E04C 2/00 |
| 2022/0194060 | A1* | 6/2022 | Chan | B32B 37/10 |
| 2022/0316219 | A1* | 10/2022 | Boo | E04F 15/02011 |
| 2022/0381042 | A1* | 12/2022 | Boucké | B32B 5/024 |

FOREIGN PATENT DOCUMENTS

| | | | |
|---|---|---|---|
| EP | 3597837 | A1 | 1/2020 |
| WO | 2011087425 | A1 | 7/2011 |

* cited by examiner

PANEL

CROSS-REFERENCE TO RELATED APPLICATIONS

The present application is a 371 of International application PCT/EP2021/075601, filed Sep. 17, 2021, which claims priority of EP 20196643.9, filed Sep. 17, 2020, the priority of these applications is hereby claimed and these applications are incorporated herein by reference.

BACKGROUND OF THE INVENTION

The invention concerns a panel comprising a panel core, a panel top side, a panel underside and a first edge pair and a second edge pair, wherein the first edge pair is provided with a groove profile at a panel edge and a tongue profile complementary thereto at the opposite panel edge, which cooperate in positively locking relationship in such a way that in the locked state movement of locked panels away from each other in the plane of the panels (horizontally) is opposed [which movement away from each other would otherwise increase the perpendicular spacing between the groove profile and the tongue profile], wherein at its opposite panel edges the second edge pair is provided with complementary hook profiles, namely a receiving hook and an arresting hook, wherein the arresting hook can be assembled to the receiving hook by a joining movement in a direction perpendicular to the panel plane, with the proviso that the receiving hook is provided with a distally outwardly open holding groove for a separate locking element with which a vertical locking action can be achieved, wherein at a corner of the panel the tongue edge of the first edge pair comes together with the receiving hook.

A panel of the general kind set forth is known from EP 1 415 056 B1. This is a panel which includes a first edge pair with a tongue-and-groove profile and a second edge pair with hook profiles. In that way the known panel can be locked at an edge with the tongue profile to the groove profile of the panels of a preceding row of panels by means of a pivotal movement; it is viewed as a great advantage that one of the edges with the hook profile can also be locked at the same time by means of the above-mentioned pivotal movement. In that situation the separate locking element latches of its own accord. The latching function of the locking element is automatically triggered by the above-mentioned pivotal movement at the first edge pair of the panel.

That panel laying mode is also referred to as fold-down laying or the appropriate panel is referred to as a fold-down panel.

Panels of that kind are connected together in rows, in which case there are transverse joins between the panels within a row. In addition longitudinal joins are respectively formed between the rows of panels of a laid coverage surface which is formed in combined relationship in that way. It is desirable that the longitudinal joins and transverse joins of such a coverage surface are to afford a certain degree of sealing integrity to prevent water from passing therethrough. In practice it has unfortunately been found that water can penetrate into joins and in places can flow from the panel top side through the join to the panel underside. Water which penetrates into the join or passes therethrough in that way can lead to the formation of mold which can spread concealed under the surface coverage. It has been found in that case that moisture can penetrate or pass through in particular by way of the transverse edge and the intersections of transverse and longitudinal edges.

SUMMARY OF THE INVENTION

The object of the invention is to propose a panel which is of an improved configuration at least in respect of the profiles of the first and/or second edge pair in order better to resist water passing through at the joins.

According to the invention that object is attained in that the holding groove provided on the receiving hook of the second edge pair for the locking element is provided with an upper groove wall which is at a spacing relative to the panel top side that is greater than the spacing between the panel top side and the tongue top side of the tongue profile of the first edge pair.

The cross-section of the holding groove for the separate locking element can be easily retained and the known locking element used. It is then desirable for the holding groove overall to be arranged deeper on the receiving hook so that the holding groove overall is at an increased spacing relative to the panel top side. That change means that the upper groove wall of the holding groove is brought to a level which is lower than the level of the tongue top side of the first edge pair. By virtue of that measure, a somewhat greater height is available for the join above the holding groove in order to achieve sealing effects by virtue of the appropriate configuration.

The change provides that the sealing integrity of the joins can be markedly improved within the coverage surface. In particular the locations of a coverage surface at which a transverse join encounters a longitudinal join exhibit better sealing integrity in relation to water passing therethrough. The regions in which a transverse join meets a longitudinal join respectively form a T-shaped arrangement of the joins and are referred to in simplified fashion as T-joins.

The proposed panel is of a quadrangular basic shape. At one of the four corners of the panel the tongue profile of the first edge pair comes together with the receiving hook of the second edge pair. Those two differing forms of the panel edges overlap in that corner whereby this results in an overlap zone in respect of the different profile shapes, in which there is a complex three-dimensional configuration. The complex configuration therefore means that the receiving hook must have the holding groove for the locking element and for that reason that holding groove comes together at the corner with the tongue profile of the adjoining panel edge of that corner. To manufacture the holding groove material of the panel core has to be removed, for example by milling. The milling of the holding groove passes through the tongue profile at an end (transitional zone) and machines a part of the panel core, that formed the tongue. A part of the material of the tongue profile is therefore machined and removed. It has surprisingly been shown that the transitional zone affords better sealing integrity in relation to water passing therethrough if the upper groove wall of the holding groove is arranged in relation to the panel top side at a lower level than the tongue top side.

With the proposed measure a portion of the material of the tongue profile is admittedly milled away in the transitional zone below the tongue top side but an upper piece of the material remains, including the tongue top side. The remaining piece of material at the tongue top side forms a cover. Viewed from above the cover closes the holding groove disposed therebeneath.

Within a coverage surface the remaining cover of the tongue top side is always disposed where there is a T-join. In that way the proposed measure improves sealing integrity and particularly effectively prevents water from passing through in the region of the T-joins.

The complementary hook profiles of the second edge pair, namely the upwardly open receiving hook and the downwardly open arresting hook, advantageously integrally have on both sides holding surfaces provided on the panel core, by means of which the locking action can be achieved to prevent the panels from moving away from each other within the panel plane in a direction perpendicular to the locked panel edges. The locking action in the vertical direction which is perpendicular to the panel top side is especially user-friendly and can be easily achieved by means of the separate locking element. Suitable locking elements are known for example from EP 1 415 056 B1, WO 2011/087425 A1, U.S. Pat. No. 9,347,469 B2 or U.S. Pat. No. 7,866,110 B2. Reference is hereby made to the examples of design configurations for separate locking elements and the arrangement thereof on a panel, as defined in the above-mentioned publications, and that technical teaching is incorporated herein. The separate locking element for the complementary hook profiles can optionally be provided as a constituent part of the panel. It is preferably then pre-fitted in the holding groove of the receiving hook.

Advantageously the carrier plate forming the basis of a panel according to the invention has a fiber material like for example a high-density fiber material (HDF) or a medium-density fiber material (MDF), an oriented strand board (OSB) or a wood-plastic composite material (WPC). It can also be provided that the panel has a decoration, in which case that decoration can be provided either by applying a decorative layer which has already been printed to a carrier plate or by direct printing of the carrier plate with such a decoration. In that respect in the present case the term direct printing is also used to mean printing of a printing background previously applied to a carrier plate. It can also be provided that the panel comprises a full wood material or is formed completely from a wood material. Advantageously such a fiber material can absorb water or liquid in the case of coming into contact with moisture, and that leads to swelling. In that case such swelling leads to an improved sealing closure in the region of the butting surface and the counterpart butting surface. In a further embodiment of the invention the carrier plate forming the basis for a panel according to the invention has a plastic material like for example a polypropylene (PP), polyethylene (PE), polyethylene-terephthalate (PET), an acrylonitrile-butadiene-styrene-copolymer (ABS), a polyvinyl chloride (PVC), a polycarbonate (PC), a polyamide (PA), a polyetherketone (PEK), polyetheretherketone (PEEK), mixtures or copolymers thereof, or a plastic composite material comprising one or more of said plastics with a fiber and/or mineral filler.

It is also viewed beneficial if at least one of the complementary panel edges is provided with an edge break at least at one of the two edge pairs.

In addition it is possible to achieve an improvement in the sealing integrity by at least one of the edge pairs at the two complementary panel edges thereof having a respective edge break which in the assembled state of two of those panels constitutes a recessed join, wherein the edge breaks of the complementary panel edges are of differing sizes and wherein in the assembled state the larger edge break is covered over by the smaller edge break. In the overlap region the larger edge break is in contact with a projection on the complementary panel edge. At its top side the projection carries at least a part of the smaller edge break.

Desirably provided at a lower end of the larger edge break is a butting surface and provided at that panel edge having the smaller edge break is a counterpart butting surface which cooperates with the butting surface, wherein the panel edge with the smaller of the two edge breaks beneath that smaller edge break has an undercut counterpart surface for the covered part of the larger edge break.

In addition the pairing of butting surface and counterpart butting surface, provided in the upper portion of the panel edges, cooperates with the locking means arranged in the lower portion of the panel edges, with which the locking action to prevent the panels from moving away from each other within the panel plane and perpendicularly to the locked panel edges is achieved. More specifically desirably the locking means disposed in the lower portion are so designed that the butting surface can be held in contact with the counterpart butting surface. In that way the closed nature of the join, that is wanted in the upper portion of the panel edge, is promoted by the locking means disposed in the lower portion.

An advantageous development provides that the butting surface provided beneath the smaller edge break and/or the counterpart butting surface are of such a configuration that there is an oversize in an upper contact region. In that way in the assembled state of two panels a pressing action can be created with the butting surface of the complementary panel edge at the upper region of the counterpart butting surface. The term "oversize" relates to the relationship of the two panel edges which can be assembled together. Starting from a theoretical nominal dimension of the two panel edges the term "oversize" is used to mean that, starting from the nominal size, more material is present either at the butting surface and/or at the counterpart butting surface so that the surface of the butting surface and/or the surface of the counterpart butting surface projects distally further than the nominal dimension. In practice this can be a maximum oversize by hundredths to a few tenths of a millimeter, which in practice produces the desired pressing action between the butting surface and the counterpart butting surface of the assembled panel edges. That desired pressing effect appropriately occurs in the upper region of the butting surface and the counterpart butting surface and can extend for example over half the height of the butting surface or counterpart butting surface.

The benefit can be further improved if the butting surface and the counterpart butting surface are so oriented that in the assembled state of two complementary panel edges a wedge-shaped gap is formed between the butting surface and the counterpart butting surface and the tip of the gap faces upwardly towards the panel top side. The wedge-shaped gap between the butting surface and the counterpart butting surface is favorable in respect of a relative movement of two assembled locked panels. The panels can acquire a kink along the locked panel edges as a point of rotation if for example they are lying on an uneven surface. In that case locked panels can assume a position relative to each other, in which their panel top sides are at an angle of >180° relative to each other.

In that case the wedge-shaped gap creates space for the required angular movement of the panel edges, within the locked panel edges. The butting surface and the counterpart butting surface are in contact and opening of the gap is resisted in that way.

It is beneficial for a closed gap if in the assembled state of two complementary panel edges the butting surface and the counterpart butting surface are in contact with each other at the tip of the wedge-shaped gap.

The wedge-shaped gap can involve a wedge angle in the range of 0°-10° and preferably 1°-5°, wherein a central axis of the wedge-shaped gap, that bisects the wedge angle, is either arranged orthogonally relative to the panel top side or is arranged in an angular range of ±5° relative to the orthogonal on the panel top side.

In addition the separate locking element can have a latching means, with which it can automatically latch into a latching contour in the complementary panel edge.

An alternative provides that the holding groove for the separate locking element has parallel groove walls, the groove walls being at a constant spacing relative to each other.

It is further helpful if the holding groove or the groove walls of the holding groove are arranged inclinedly relative to the panel top side.

It is further useful if the free opening of the inclinedly arranged holding groove is directed upwardly, that is to say in the direction of the panel top side.

BRIEF DESCRIPTION OF THE DRAWING

The invention is described in detail hereinafter by means of a number of embodiments and illustrated by way of example in a drawing in which.

DETAILED DESCRIPTION OF THE INVENTION

Figure 1:
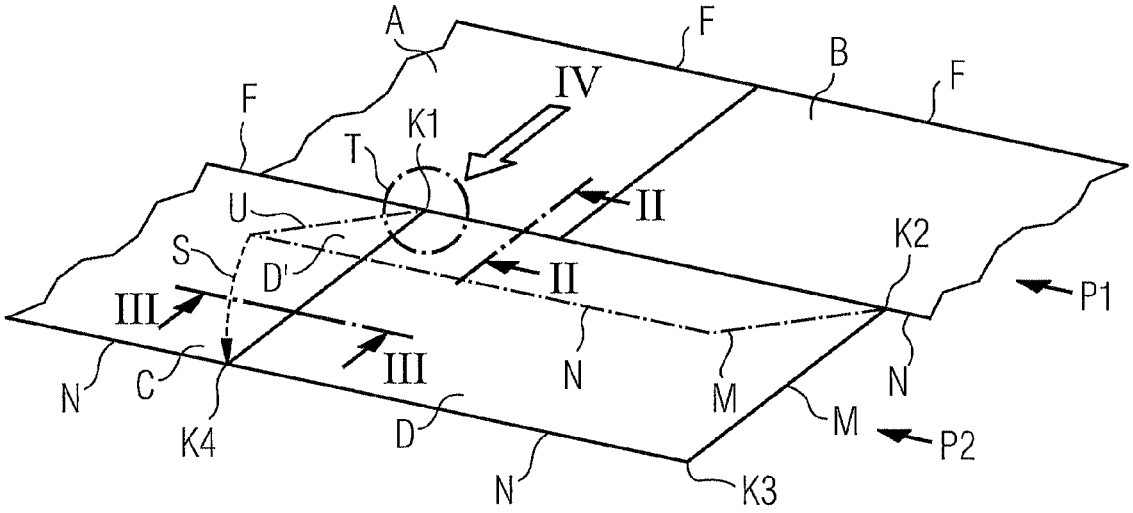
FIG. 1 shows a diagrammatic view of a plurality of panels according to the invention in combination.

FIG. 1 diagrammatically shows four panels A, B, C and D according to the invention, more specifically assembled in combination to form a coverage surface which can be used for a building wall, ceiling or a floor. The panel according to the invention has four panel edges F, M, N and U and four corners K1, K2, K3 and K4. It has a panel top side O, a panel underside G and a panel core E. The panel has two edge pairs. A first edge pair includes the panel edges N and F, wherein the panel edge N has a groove profile 1 and a panel edge F has a tongue profile 2, which are described in greater detail hereinafter with reference to FIG. 2. A second edge pair includes the panel edges M and U which are in the form of hook profiles. The panel edge M is in the form of a receiving hook 3 and is provided with a holding groove for a separate locking element 5. The locking element 5 is fitted and used in such a way that it locks in the vertical direction (vertical locking element). The panel edge U is in the form of an arresting hook 6 which can be connected to the receiving hook 3 in a vertical direction downwardly. If a vertical locking element 5 is used the vertically acting locking effect takes place automatically, as is described in detail hereinafter with reference to FIG. 3. By virtue of the two different panel edges the panel A, B, C, D is suitable for locking by a pivotal movement (fold-down). The pivotal movement is indicated in FIG. 1 by means of the panel D which is shown in broken line in an inclined starting position D'. The panel D is moved down from its starting position D' in the direction of the arrow of the pivotal movement S by a single downwardly pivotal movement about its panel edge F as the axis of rotation. In that case it locks to the groove profile N of the panels A and B of a preceding row of panels P1. At the same time the panel edge U of the panel D is locked to the panel edge M of the panel C which is in the same row of panels P2.

As shown in FIG. 1 at the corner K1 of the panel D the panel edge F (first edge pair) meets the panel edge U (second edge pair). That corner K1 is found to be particularly critical in regard to sealing integrity of the coverage surface in relation to water passing therethrough. At the critical corner K1 the tongue profile 2 of the panel edge F meets the arresting hook 6 of the panel edge U.

The cross-sections of the tongue profile 2 and the arresting hook spatially overlap and that affords a complex spatial configuration at the corner K1.

In combination with further identical panels A and C the corner K1 in question of the panel D is in a region marked by IV. There a T-shaped join is formed, composed of a longitudinal join (panel edges F/N) and a transverse join (panel edges M/U). A view on to that T-join in the direction of view of the arrow IV is described in detail hereinafter with reference to FIG. 4.

Figure 2:
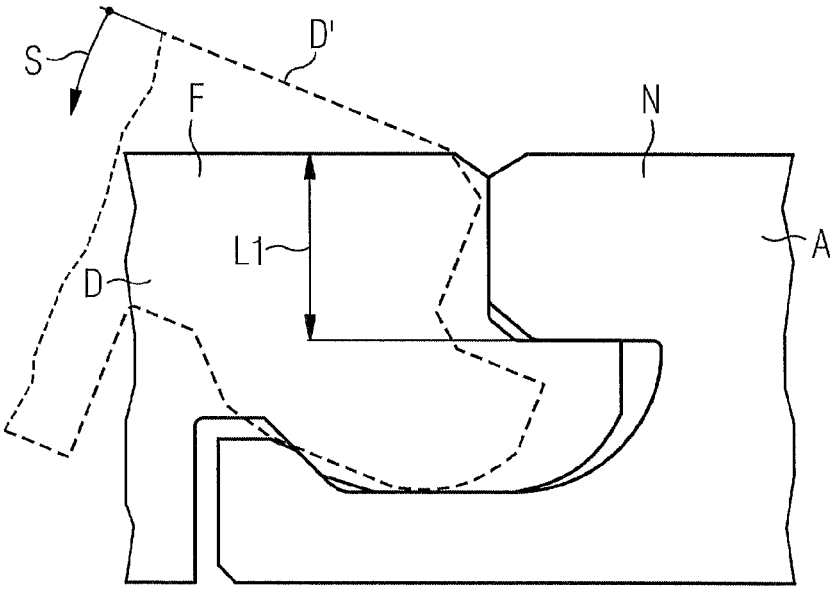
FIG. 2 shows by way of example a cross-section through a first edge pair of a panel according to the invention in the locked state.

Reference is made to FIG. 2 to show by way of example a first edge pair of the panel according to the invention in cross-section. The direction of view corresponds to the section line II-II shown in FIG. 1. The panel edges F and N of the panels D and A are opposite in FIG. 2 as indicated in FIG. 1 by means of the section line II-II. The panel edge F is provided with a tongue profile and the panel edge N is provided with a complementary groove profile. Those complementary panel edges F/N can be shown portion-wise in the locked state, as if the panel is divided into two parts. That form of illustration is intended to make it easier to understand the functionality and cooperation of the complementary panel edges. A starting position D' of the panel edge F indicates a pivotal movement S. The tongue top side is at a spacing L1 relative to the panel top side. It will be appreciated that a plurality of panels of the kind according to the invention can be locked together in the same way to provide a coverage surface for a building wall, a floor or a ceiling. For that reason FIGS. 2 and 3 can also each be viewed as being two panels which are shown portion-wise.

Figure 3:
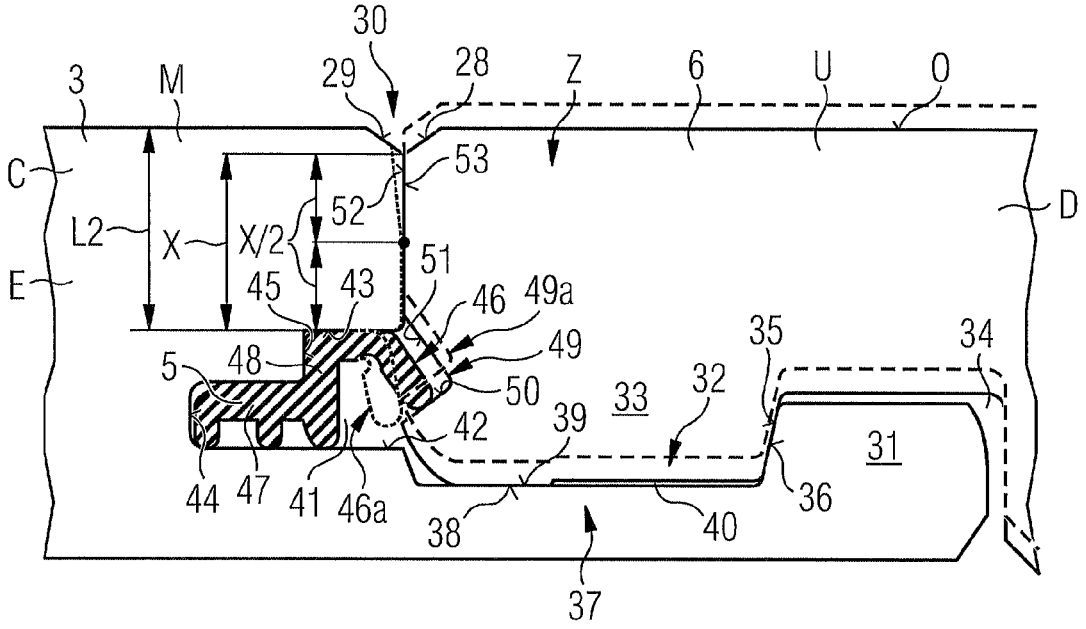
FIG. 3 shows a cross-section through the second edge pair of the panel according to the invention in the locked state.

The panel edge M in the form of the receiving hook 3 and the panel edge U in the form of the arresting hook 6 of the second edge pair are shown in cross-section in FIG. 3, more specifically also in the assembled locked state. The direction of view corresponds to the section line shown in FIG. 1.

At the panel top side O the two panel edges M and U of the second edge pair have an edge break. The edge breaks are in the form of chamfers 28 and 29 respectively. In this example the two chamfers are of the same size and in the locked state produce a symmetrical V-join 30.

The receiving hook 3 and the arresting hook 6 lock the assembled panel edges M/U in the vertical direction and also in the horizontal direction. In this embodiment, for the vertical locking action, it is possible to use a separate locking element 5 (vertical locking element) which can be provided with resilient properties. Suitable vertical locking elements are known for example from the following publications: EP 1 415 056 B1, WO 2011/087425 A1 and US 2014/0366476 A1.

For the horizontal locking action, as shown in FIG. 3 the receiving hook 3 of the panel edge M is provided distally with a hook edge 31 which projects in the direction of the panel top side O and with a receiving recess 32 which is open to the panel top side O. The arresting hook 6 of the panel edge U has an arresting step 33 projecting in the direction of the panel underside G and a downwardly open arresting recess 34. The arresting step 33 fits into the receiving recess 32 of the receiving hook 3 and cooperates therewith.

The receiving hook 3 at the hook edge 31 has a holding surface 35 directed towards the panel core E. Likewise provided on the arresting hook 6 is a holding surface 36 which is also directed towards the panel core E and which with the holding surface 35 on the hook edge 31 gives an undercut configuration and thus provides a locking action to prevent the panels C and D from moving away from each other within the panel plane in a direction perpendicular to the locked panel edges M/U (horizontally).

The holding surface 35 of the receiving hook 3 is provided at a proximal side of the hook edge 31. The surface normal of the holding surface 35 is directed towards the panel core E of the panel C. Likewise arranged on the receiving hook 6 the holding surface 36 thereof is arranged at a proximal side of the arresting step 33 and its surface normal is directed towards the panel core E of the panel D.

In the present example the arresting step 33 at a step underside 37 has a distal step surface 38 which is in contact with a bottom 39 of the receiving recess 32 and a proximal recess 40 which extends laterally as far as the holding surface 36 of the arresting step 33. The recess 40 uses good contact in respect of the holding surfaces 35/36 of the hook edge and the arresting step.

The vertical locking element is provided with a distally projecting latching means 46 which during the joining movement automatically latches into a lateral latching recess provided at the complementary panel edge 1. The joining movement is a pivotal movement as noted in FIG. 1 by the arrow G.

Provided in the receiving hook is a holding groove 41 for the locking element 5. The holding groove 41 has a flat lower groove wall 42, an upper groove wall 43 and a groove bottom 44. The upper groove wall 43 is provided with a step 45. The step 45 is so arranged that towards the groove bottom there is a narrower part of the holding groove 41 and a region of a greater width, that is directed towards the open side of the holding groove 41.

It is important that the upper groove wall 43 is arranged at a spacing L2 from the panel top side O and that the spacing L2 is always greater in comparison than the spacing L1 between the tongue top side 19 and the panel top side O.

The configuration of the holding groove 41 with the step 45 is adapted to the locking element 5, the cross-section of which is shown by way of example in FIG. 3. In the case of the illustrated hatched locking element 5 the latching means 46 is in the form of a latching tab **46*a* which projects inclinedly downwardly and which protrudes from the holding groove 41, and a holding means 47 facing towards the bottom of the holding groove 41. The locking element 5 also has a shoulder 48 which is supported against the step 45 of the upper groove wall 43**.

During a pivotal movement for locking the panel D the arresting hook 6 comes into contact with the distally projecting latching means 46 or the latching tab **46*a* of the locking element 5 and pushes it back in the direction of the holding groove 41. The pivotal joining movement is indicated in simplified form in FIG. 3 by a downwardly directed arrow Z. FIG. 3 shows in broken line an intermediate position during the pivotal movement of the arresting hook 6. In the illustrated intermediate position the latching means 46 (latching tab 47) of the locking element is pushed back in the direction of the holding groove 41 and resiliently prestressed. In the finished locked position the locking element has then again reduced the resilient spring stress and is moved in the direction of its neutral position and therewith also moved into a latching contour 49 of the arresting hook 6, said contour being in the form of a locking groove 49*a*. The locking groove 49*a* has a lower inclined groove wall 50 and an upper inclined groove wall 51. In FIG. 3 a residual amount of elastic spring stress is still maintained in the latching means 46** whereby vertical latching remains permanently without play in that way.

Provided on the receiving hook 3 beneath the chamfer 29 is a butting surface 52. The butting surface is arranged in orthogonal relationship with the panel top side O.

Provided on the arresting hook 6 beneath the chamfer 28 is a counterpart butting surface 53 which in this example is inclined through an angle of 3° relative to the orthogonal on the panel top side O. The cross-section of the arresting hook 6 is shown as a broken line in FIG. 3 in the region of the counterpart butting surface 53 in order to show the neutral configuration, as though it were not fitted together with the receiving hook 3. It is shown in that respect that the broken line in the region of the counterpart butting surface 51 overlaps the cross-section of the complementary receiving hook 3, more specifically where it has its butting surface 52. The excess at the counterpart butting surface is shown on an exaggerated scale in FIG. 3 for the sake of greater visibility. In practice this involves hundredths to a few tenths of a millimeter of maximum depth of the overlap. In practice the overlap affords a pressing action in respect of the assembled panel edges M and U between the butting surface 50 and the counterpart butting surface 53.

That desired pressure action occurs in the upper region of the butting surface 52 and the counterpart butting surface 53. For that purpose the configuration is such that the size of the overlap extends over half the height (X/2) of the region (X)

of the panel edges, that the butting surface 52 and the counterpart butting surface 53 occupy.

Figure 4:
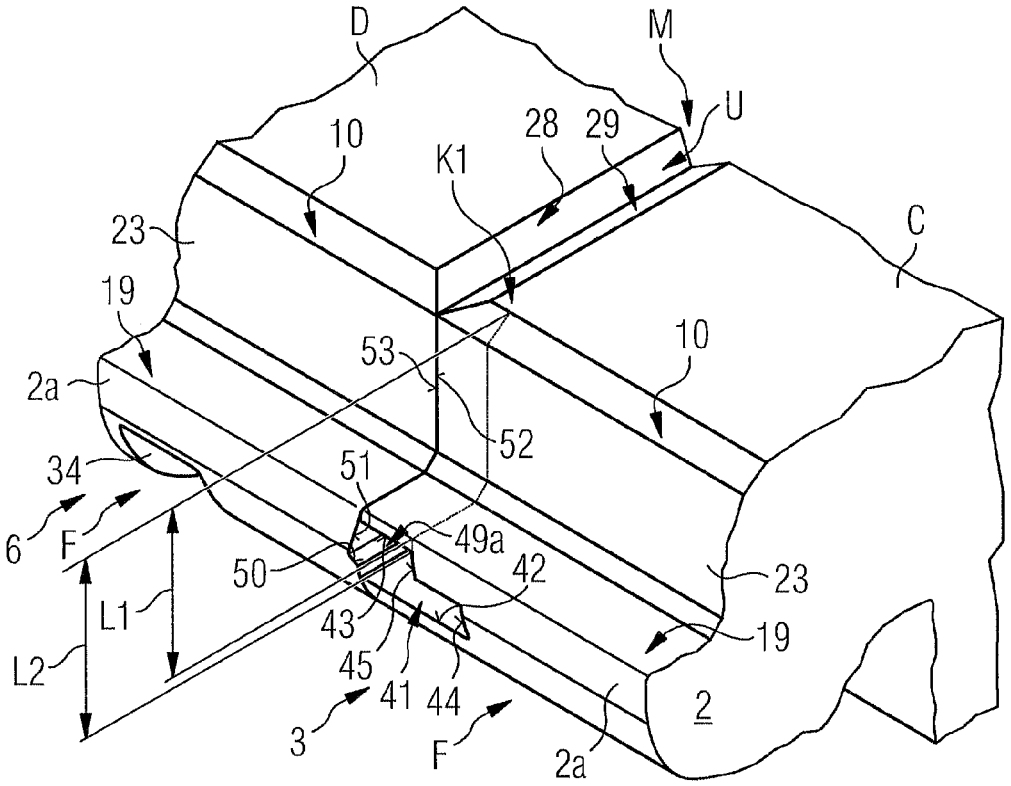
FIG. 4 shows a perspective view of two panel portions having the panel edges of FIG. 2 in the locked state and with the tongue profile shown in FIG. 1.

FIG. 4 shows an isometric view of two connected panels C and D. The view corresponds to the direction of view IV as noted in FIG. 1. In the foreground of FIG. 4 it is possible to see the tongue profiles of the panel edges F of the panels C and D. The panel edge M of the panel C and the panel edge U of the panel D extend rearwardly in the perspective view. The panel edge M is provided with the receiving hook 3 and the panel edge U is provided with the arresting hook 6 as shown in FIG. 3.

In addition FIG. 4 notes the critical corner K1 of the panel C, at which the receiving hook 3 inclusive of the holding groove 41 provided for the locking element 5 (panel edge M) comes together with the tongue profile 2 (panel edge F). The perspective view of FIG. 4 clearly shows that the holding groove 41 extends through the tongue profile 2 and issues at the tongue tip 2*a*. At the tongue tip 2*a* the end cross-section of the holding groove 41 can be clearly seen. Provided on the complementary panel D is the locking groove 49*a* in which the locking element 5 can be pre-fitted and can be automatically latched during assembly of a coverage surface. The locking element 49*a* also extends on the panel D through the tongue profile 2 and ends as an open cross-section at the tongue tip 2*a*. In the receiving hook it is possible to see the holding groove 41 for the locking element, which has the flat lower groove wall 42, the upper groove wall 43 and the groove bottom 44. The upper groove wall 43 is provided with the step 45 and that step 45 is so arranged that facing towards the groove bottom there is a narrower part of the holding groove 41 and a region of a greater width, directed towards the open side of the holding groove 41. The locking groove 49*a* can be seen on the arresting hook 6.

The arresting hook 6 (panel edge U) of the panel D also includes the downwardly open arresting recess 34 shown in cross-section in FIG. 3. The arresting recess also extends transversely through the tongue profile 2 of the panel D and issues in the lower region of the tongue profile. The open cross-section of the arresting recess 34 issues beneath the tongue tip 2*a*. The spacing L1 between the tongue top side 19 and the panel top side O is shown beside the spacing L2 of the upper groove wall 43 of the holding groove 41, wherein L2>L1.

It is important that the novel configuration means that the holding groove 41 for the locking element 5 is arranged overall deeper than in the state of the art, more specifically so deeply that the cross-section of the holding groove 41 is on a level beneath the tongue top side 19. By virtue of that measure, admittedly a part of the material of the tongue profile 2 is removed during manufacture of the holding groove 41, but the tongue top side 19 is retained to afford a certain thickness of material. Maintaining the tongue top side 19 at that critical corner K1 of the panel C has been found to be an improvement in terms of sealing integrity of a coverage surface because the tongue top sides 19 of the panels C and D arranged without a gap in a row with each other afford a more sealed T-join and that applies to every T-join in a coverage surface, that is afforded with the panel according to the invention. That works because the tongue top side 19 remaining on the panel C bears laterally without a gap against the tongue profile 2 of the panel D so that there at least at the tongue top sides 19 the arrangement affords a closed configuration which resists the passage of water therethrough. Particularly when the tongue profiles 2 which are arranged in a row with each other are fitted into a complementary groove profile 1 so that this affords the finished T-join better sealing integrity is then achieved.

Figure 5:
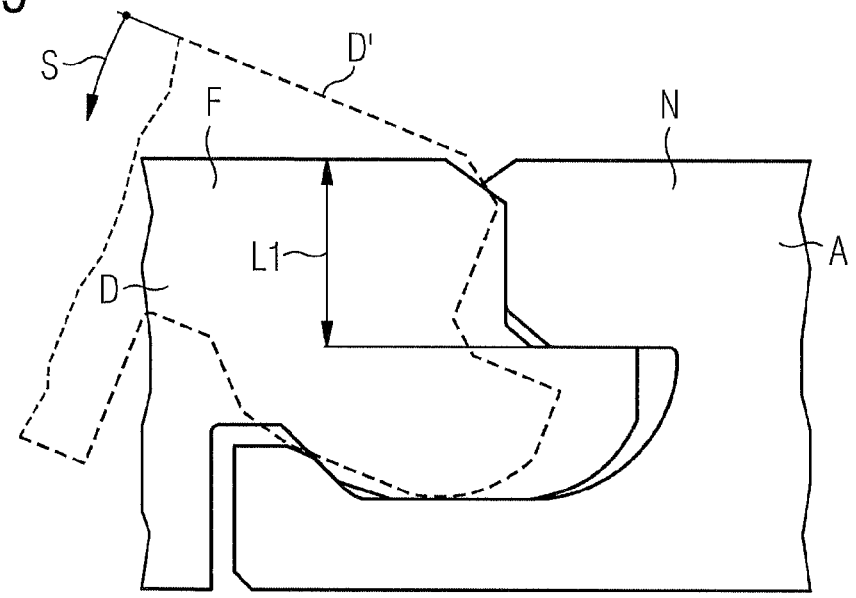
FIG. 5 shows a cross-section through the first edge pair of a second embodiment of the panel according to the invention in the locked state.

FIG. 5 shows a cross-section through the first edge pair of a second embodiment of the panel according to the invention in the locked state. The direction of view corresponds to that direction of view shown for FIG. 2, which is illustrated for orientation purposes as the section line II-II in FIG. 1. Unlike FIG. 2, in FIG. 5 the edge breaks are changed at the top on the panel edges. For that purpose, provided at the tongue profile of the panel edge F is a chamfer which is larger and in comparison therewith provided at the tongue profile of the panel edge N is a smaller chamfer. The larger chamfer is partially covered over by the smaller chamfer.

Figure 6:
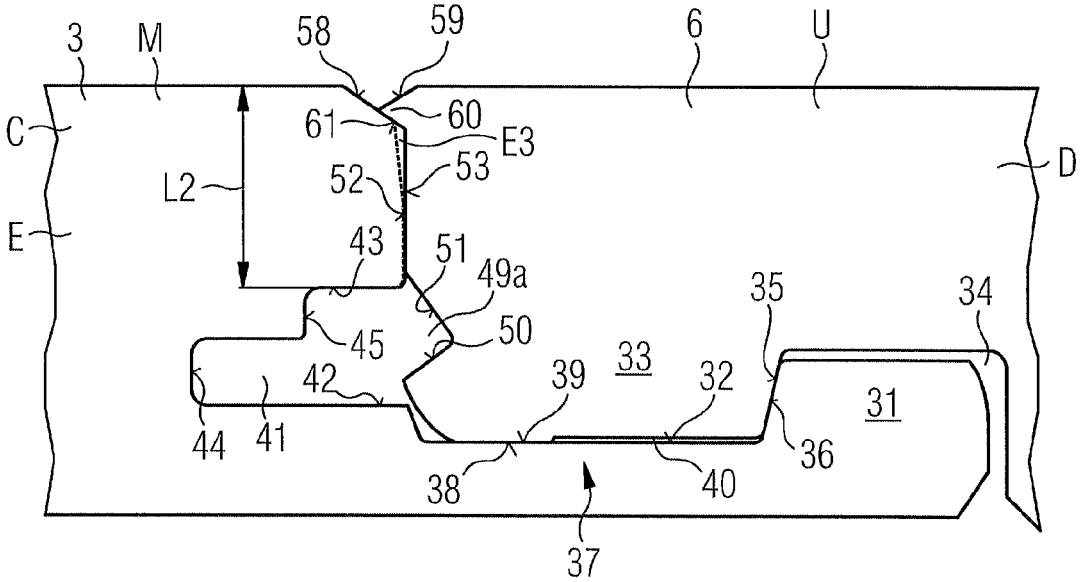
FIG. 6 shows a cross-section through the second edge pair of the second embodiment of the panel according to the invention in the locked state.

FIG. 6 shows a cross-section through the second edge pair of the second embodiment of the panel according to the invention in the locked state. This embodiment is based on the second edge pair shown in FIG. 3. The direction of view corresponds to that direction provided for FIG. 3, which is shown for orientation as the section line in FIG. 1. The example in FIG. 6 differs from FIG. 3 by modified edge breaks upwardly at the panel edges M and U. The panel edge M with the receiving hook 3 is provided with an edge break which is in the form of a larger chamfer 58, more specifically larger in comparison with a smaller chamfer 59 on the arresting hook 6 of the panel edge U. The smaller chamfer 59 is arranged on a distal projection 60. The larger chamfer 58 is partially covered over by the smaller chamfer 59, thereby affording a V-join. In the overlap region the larger chamfer is in contact with the projection 60 of the arresting hook 6. Arranged beneath the smaller chamfer 59 on the projection 60 is an undercut counterpart surface 61 which is in contact with the covered part of the larger chamfer 58. That contact substantially affords a seal in relation to the ingress of water which is not to pass into the transverse join. In addition the butting surface 52 of the panel edge U is provided with an oversize E3 in the upper region so that in the upper region, in the assembled state, a pressing action can be generated against the counterpart butting surface 53 of the complementary panel edge M, which has a sealing effect. Oversize relates to the ratio of the two panel edges which can be assembled together. Starting from a theoretical nominal dimension of the two panel edges more material is present in this example at the counterpart butting surface 53 so that the surface of the counterpart butting surface 53 projects distally further in comparison with its nominal dimension. The material region which projects in comparison with the nominal dimension represents the oversize E3. In practice this can be a maximum oversize by hundredths to a few tenths of a millimeter, which provides the desired pressing action between the butting surface 52 and the counterpart butting surface 53 of the assembled panel edges. As shown in FIG. 6 the desired pressing action occurs in the upper region of the butting surface 52 and the counterpart butting surface 53 and extends substantially over half the height of the butting surface 52 and the counterpart butting surface 53 respectively.

Figure 7:
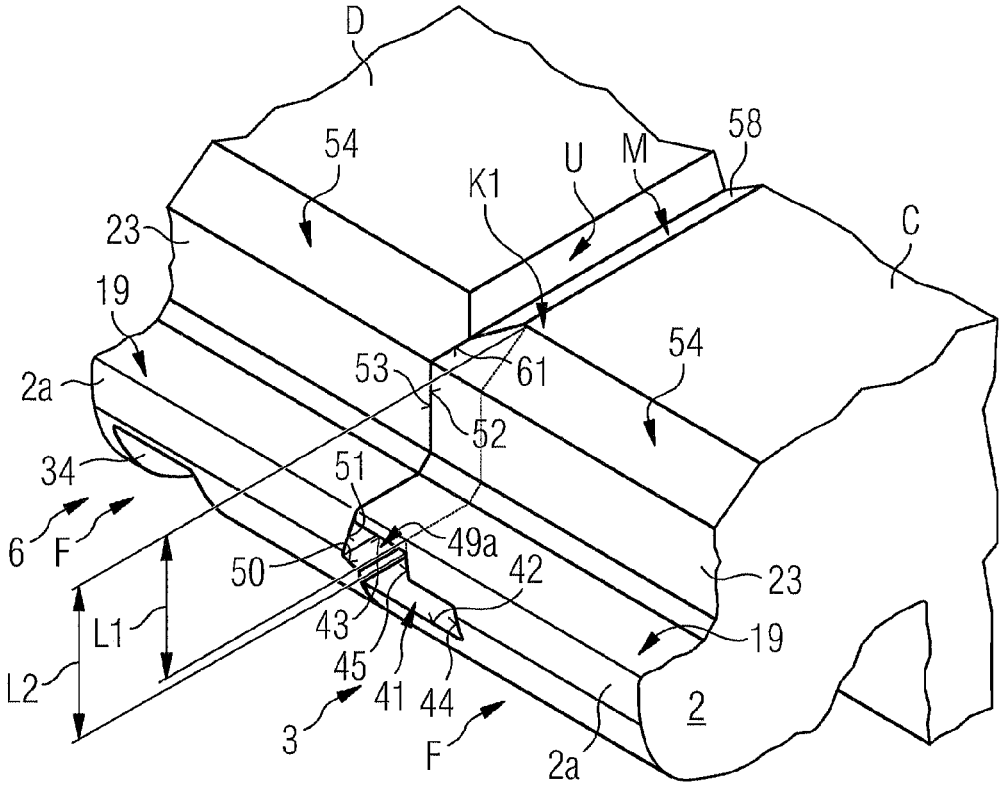
FIG. 7 shows a perspective view of two panel portions of the second embodiment of the panel with the panel edges shown in FIG. 5 in the locked state and with the tongue profile shown in FIG. 4.

FIG. 7 shows a perspective view of portions of the panels C and D. There it is possible to see the panel edges M and U of FIG. 6 in the locked state. In addition the tongue profiles of the panel edges F of the panels C and D are shown there, corresponding to the tongue profile 2 shown in FIG. 5. That tongue profile 2 has the edge break in the form of the larger chamfer 34 which is to be seen in the perspective view in FIG. 7 above the tongue top side 19.

Figure 8:
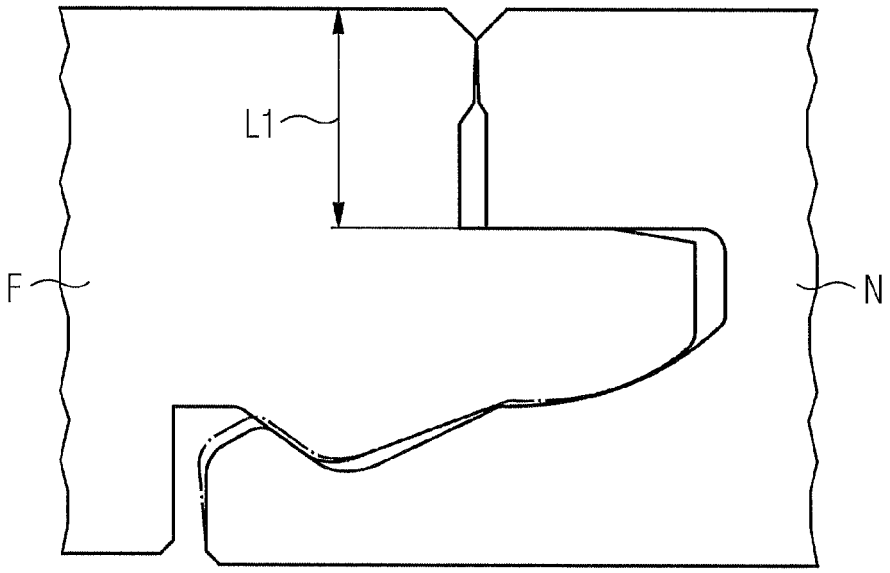
FIG. 8 shows an alternative cross-section through a first edge pair of a panel according to the invention in the locked state.

FIG. 8 shows a third alternative for the first edge pair of the panel according to the invention in the locked state. The panel has a panel edge F with a tongue profile and a panel edge N with a groove profile. The two panel edges F and N are locked in positively locking relationship by the illustrated configuration of the complementary panel edges, more specifically both in the vertical direction and also in the horizontal direction.

Figure 9:
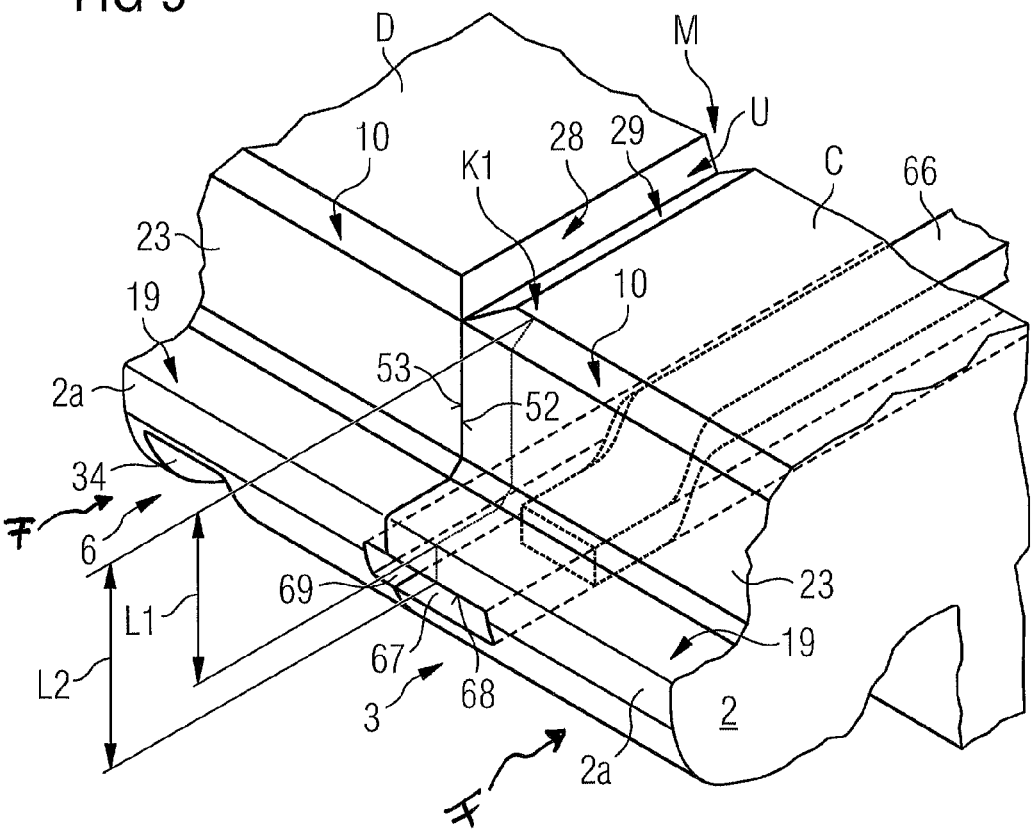
FIG. 9 shows a perspective view of two panel portions of a further embodiment of the panel.

FIG. 9 shows a perspective view of two panel pieces of a fifth embodiment of the panel. The configuration is based on the example of FIG. 4, to which reference is directed. The example in FIG. 9 differs from FIG. 4 because it is designed for a different kind of locking element 66. A holding groove 67 of rectangular cross-section is provided on the receiving hook 3 for that locking element 66, wherein the locking element 66 can be pre-fitted into the groove. The holding groove 67 has an upper groove wall 68 arranged at a spacing L2 from the panel top side. The arresting hook 6 also has a latching contour in the form of a locking groove 69, and the cross-section thereof is suitably matched so that the locking element 66 can be automatically latched there. The holding groove 67 proposed in FIG. 9 is intended for example for use of an arcuate locking element, as is known from US 2014/0366476 A1 (see FIG. 3*b*) or for a locking element with rearward resilient bristles which bear against the groove bottom of the holding groove, as is also known from US 2014/0366476 A1 (see FIG. 6*a* or 6*b* therein). It is important that the tongue top side 19 of the tongue profile 2 of the panel edge F is arranged at a higher level than the holding groove 67 of the receiving hook 3. The tongue profile 2 of the panel edge F comes together with the receiving hook 3 at the critical corner K1 of the panel. The holding groove extends in the region of the corner K1 through the tongue profile so that material of the tongue profile is removed. The tongue top side 19 however is not removed. Between the panel top side O and the tongue top side 19 there is a spacing L1 which is less than the spacing L2 between the upper groove wall 68 of the holding groove 67 and the panel top side O. In that way material always remains at the tongue top side as far as a certain material thickness.

Preserving the tongue top side 19 at that critical corner K1 of the panel C is an improvement in terms of sealing integrity of a coverage surface because the tongue top sides 19 of the panels C and D arranged in a row without a gap between them afford a better sealed T-join and that applies to any T-join in a coverage surface, which is implemented with the panel according to the invention. That functions because, as shown in FIG. 9, the tongue top side 19 remaining on the panel C butts laterally without a gap against the tongue profile 2 of the panel D. In that way at least at the tongue top sides 19 this affords a closed configuration which resists water from passing through. In particular if the tongue profiles 2 which are arranged in a row are inserted into a complementary groove profile 1 so that the finished T-join is formed, that gives particularly good sealing integrity.

Figure 10:
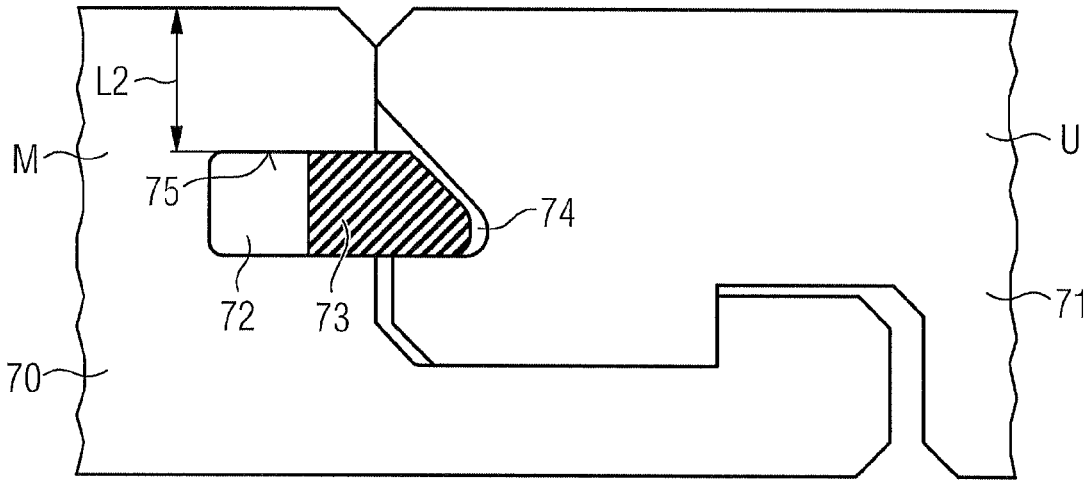
FIG. 10 shows an alternative cross-section through a second edge pair of the panel according to the invention in the locked state.

FIG. 10 shows an alternative cross-section through the second edge pair of the panel according to the invention in the locked state. This example includes a receiving hook 70 at a panel edge M and an arresting hook 71 at a panel edge U. A holding groove 72 for a locking element 73 is provided in the receiving hook 70. The holding groove 72 has parallel groove walls. In addition in this example the spacing of the groove walls relative to each other is constant. The arresting hook 71 has a contour 74, into which the locking element 73 can automatically latch during a joining movement. The holding groove 72 for the locking element 73 is arranged substantially parallel to the panel top side. An upper groove wall 75 of the holding groove 72 is at a spacing L2 relative to the panel top side, that is always larger than the spacing L1 provided at the first edge pair between a tongue top side and the panel top side, as shown in FIGS. 5, 8 and 11.

Figure 11:
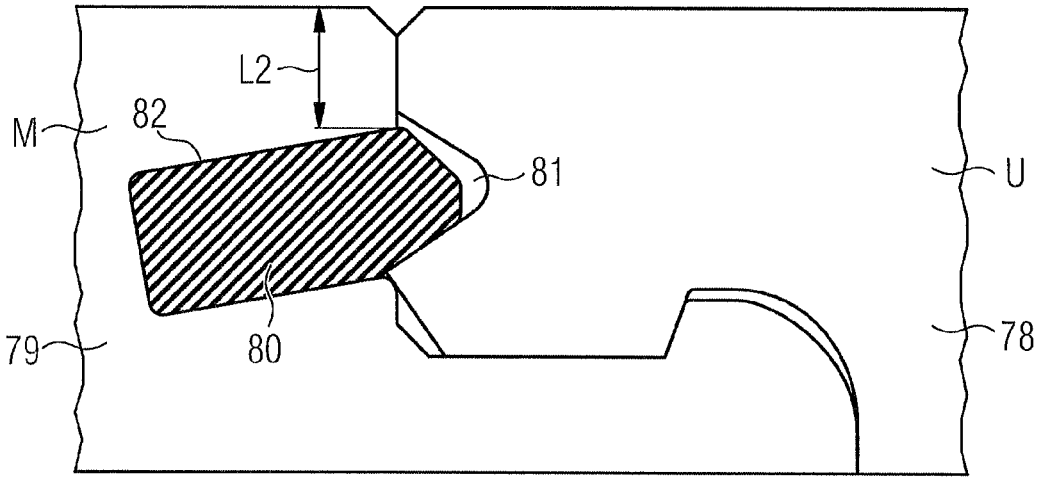
FIG. 11 shows a further example of a cross-section through a second edge pair of the panel according to the invention in the locked state.

FIG. 11 shows a further example of a second edge pair. Once again there is a receiving hook 77 at a panel edge M and an arresting hook 78 at a panel edges U. The receiving hook 77 includes a holding groove 79 for a locking element 80. The arresting hook 78 has a contour 81 in which the locking element 80 can automatically latch. The holding groove 79 has parallel groove walls. In addition in this example the spacing of the groove walls relative to each other is constant. As a difference in relation to FIG. 10 the holding groove 79 in the receiving hook 77 is arranged inclined relative to the panel top side. The free opening of the inclinedly arranged holding groove 79 is directed upwardly in the direction of the panel top side. The upper groove wall 82 of the holding groove 79 is at a spacing L2 relative to the panel top side, which is always larger than the spacing L1, provided at the first edge pair, between a tongue top side and the panel top side, as shown in FIGS. 5, 8 and 11.

Figure 12:
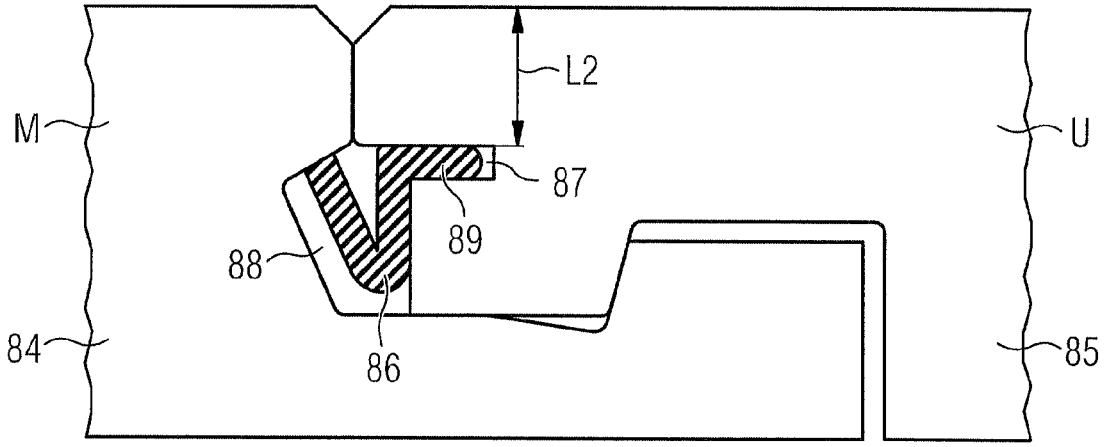
FIG. 12 shows yet another embodiment of a cross-section through the second edge pair of the panel according to the invention in the locked state.

FIG. 12 shows yet another example of a cross-section through the second edge pair of the panel according to the invention in the locked state. This example also have a receiving hook 84 at a panel edge and an arresting hook 85 at a panel edge U, which are automatically lockable in the vertical direction by means of a locking element 86. In this example there is a holding groove 87 for the locking element 86 on the other hook element, namely the arresting hook 85, and the receiving hook 84 has a contour 88 into which the locking element 86 can automatically latch. An upper groove wall 89 of the holding groove 87 is at a spacing L2 relative to the panel top side, that is always larger than the spacing L1 between the tongue top side and the panel top side, as noted with reference to FIGS. 5, 8 and 11 on the first edge pair.

Figure 13:
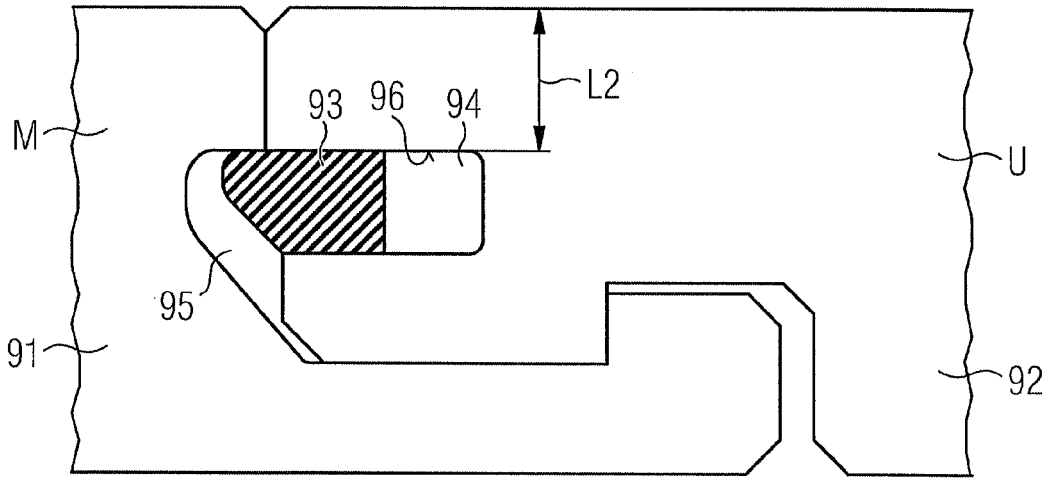
FIG. 13 shows a further alternative of a cross-section through the second edge pair of the panel according to the invention in the locked state.

FIG. 13 shows a further alternative of a cross-section through the second edge pair. This example again has a receiving hook 91 and an arresting hook 92 which are automatically lockable in the vertical direction by means of a locking element 93. As in FIG. 12 this embodiment also provides a holding groove 94 for the locking element 93 on the arresting hook 92 and the receiving hook 91 has a contour 95 into which the locking element 93 can automatically latch. The holding groove 94 has parallel groove walls. The groove walls are also at a constant spacing relative to each other. An upper groove wall 96 of the holding groove 94 is at a spacing L2 relative to the panel top side, that is always larger than the spacing L1 between the tongue top side and the panel top side, as noted with reference to FIGS. 5, 8 and 11 on the first edge pair.

LIST OF REFERENCES

1 groove profile
2 tongue profile
2*a* tongue tip
3 receiving hook
5 locking element
6 arresting hook
7 shorter upper groove wall
8 longer lower groove wall
9 chamfer
10 chamfer
11 V-join
12 holding edge
28 chamfer
29 chamfer
30 V-join
31 hook edge

32 receiving recess
33 arresting step
34 arresting recess
35 holding surface
36 holding surface
37 step underside
38 step surface
39 bottom (receiving recess)
40 recess
41 holding groove
42 lower groove wall
43 upper groove wall
44 groove bottom
45 step (upper groove wall)
46 latching means
46*a* latching tab
47 holding means
48 shoulder
49 latching contour
49*a* locking groove
50 lower inclined groove wall
51 upper inclined groove wall
52 butting surface
53 counterpart butting surface
54 larger chamfer
55 smaller chamfer
56 projection
57 undercut counterpart surface (projection)
58 larger chamfer
59 smaller chamfer
60 projection
61 counterpart surface (projection)
66 locking element
67 holding groove
68 upper groove wall
69 locking groove
70 receiving hook
71 arresting hook
72 holding groove
73 locking element
74 locking element
75 upper groove wall
77 receiving hook
78 arresting hook
79 holding groove
80 locking element
81 locking element
82 upper groove wall
84 receiving hook
85 arresting hook
86 holding groove
87 locking element
88 locking element
89 upper groove wall
91 receiving hook
92 arresting hook
93 locking element
94 holding groove
95 contour
96 upper groove wall
A panel
B panel
C panel
D panel
D' starting position
E panel core
E3 oversize
F panel edge
M panel edge
N panel edge
U panel edge
S pivotal movement
K1 corner
K2 corner
K3 corner
K4 corner
L1 spacing
L2 spacing
P1 row of panels
P2 row of panels
O panel top side
G panel underside
Z arrow

The invention claimed is:

1. A panel comprising a panel core, a panel top side, a panel underside and a first edge pair and a second edge pair, wherein the first edge pair is provided with a groove profile at a panel edge and an integral tongue profile complementary thereto at the opposite panel edge, which cooperate in positively locking relationship in such a way that in the locked state movement of locked panels away from each other in the plane of the panels is opposed, wherein the tongue profile is unitary with the panel core, wherein at its opposite panel edges the second edge pair is provided with complementary hook profiles, namely a receiving hook and an arresting hook, wherein the receiving hook has a hook edge that forms an outermost edge surface of the panel, wherein the receiving hook has a butting surface setback from the outer most edge surface of the panel, wherein the arresting hook can be assembled to the receiving hook by a joining movement in a direction perpendicular to the panel plane, with the proviso that the receiving hook is provided with a holding groove for a separate locking element with which a vertical locking action can be achieved, wherein the holding groove is arranged in the butting surface, wherein at a corner of the panel the tongue edge of the first edge pair comes together with the receiving hook, wherein the holding groove provided on the receiving hook of the second edge pair for the locking element has an upper groove wall which is of a spacing relative to the panel top side that is greater than the spacing between the panel top side and the tongue top side of the tongue profile of the first edge pair.

2. The panel according to claim 1, wherein at least one of the edge pairs at at least one of the complementary panel edges is provided with an edge break.

3. The panel according to claim 1, wherein at least one of the edge pairs at two complementary panel edges thereof has a respective edge break which in the assembled state of two of said panels forms a recessed join, wherein the edge breaks of the complementary panel edges are of different sizes and in the assembled state the larger edge break is covered over by the smaller edge break.

4. The panel according to claim 3, wherein the butting surface is provided at a lower end of the larger edge break, provided at that panel edge having the smaller edge break is a counterpart butting surface which cooperates with the butting surface, wherein the panel edge with the smaller of the two edge breaks beneath that smaller edge break has an undercut counterpart surface for the covered part of the larger edge break.

5. The panel according to claim 4, wherein the counterpart butting surface is of such a configuration that it is provided with an oversize in its upper region so that with the upper region of the counterpart butting surface in the assembled state a pressing action can be created against the butting surface of the complementary panel edge.

6. The panel according to claim 4, wherein the butting surface and the counterpart butting surface are so oriented that in the assembled state of two complementary panel edges a wedge-shaped gap is formed between the butting surface and the counterpart butting surface, and the tip of the wedge-shaped gap faces upwardly towards the panel top side.

7. The panel according to claim 6, wherein in the assembled state of two complementary panel edges the butting surface and the counterpart butting surface are in contact with each other at the tip of the wedge-shaped gap.

8. The panel according to claim 6, wherein the wedge-shaped gap has a wedge angle in the range of 0°-10° and that a central axis of the wedge-shaped gap, that bisects the wedge angle, is either arranged in orthogonal relationship with the panel top side or is arranged in an angular range of +5° relative to the orthogonal on the panel top side.

9. The panel according to claim 8, wherein the wedge-shaped gap has a wedge angle in the range of 1°-5°.

10. The panel according to claim 1, wherein the separate locking element has a latching means with which it is latchable in a latching recess of the complementary panel edge.

11. The panel according to claim 1, wherein the holding groove for the separate locking element has parallel groove walls.

* * * * *